US010174964B2

(12) United States Patent
Goel et al.

(10) Patent No.: US 10,174,964 B2
(45) Date of Patent: Jan. 8, 2019

(54) OPTIMIZED DEHUMIDIFICATION WITH HVAC SYSTEMS

(71) Applicant: Lennox Industries Inc., Richardson, TX (US)

(72) Inventors: Rakesh Goel, Irving, TX (US); Peter Hrejsa, Frisco, TX (US)

(73) Assignee: Lennox Industries Inc., Richardson, TX (US)

( * ) Notice: Subject to any disclaimer, the term of this patent is extended or adjusted under 35 U.S.C. 154(b) by 325 days.

(21) Appl. No.: 14/947,764

(22) Filed: Nov. 20, 2015

(65) Prior Publication Data

US 2017/0146257 A1 May 25, 2017

(51) Int. Cl.

| | |
|---|---|
| ***F24F 11/62*** | (2018.01) |
| ***F24F 11/30*** | (2018.01) |
| *F24F 110/10* | (2018.01) |
| *F24F 110/20* | (2018.01) |
| *F24F 11/65* | (2018.01) |

(52) U.S. Cl.

CPC ..... *F24F 11/62* (2018.01); *F24F 11/30* (2018.01); *F24F 11/65* (2018.01); *F24F 2110/10* (2018.01); *F24F 2110/20* (2018.01)

(58) Field of Classification Search

CPC . F24F 11/0012; F24F 11/0015; F24F 11/0008
See application file for complete search history.

(56) References Cited

U.S. PATENT DOCUMENTS

2010/0031680 A1* 2/2010 Eisenhour ..... B60H 1/3207 62/176.1
2012/0291467 A1* 11/2012 Sasaki ..... B60H 1/3208 62/151

FOREIGN PATENT DOCUMENTS

JP 2004245552 A * 9/2004

OTHER PUBLICATIONS

Miki et al., Air Conditioning Control Method and Device, Sep. 2, 2004, JP2004245552A, Whole Document.*

* cited by examiner

*Primary Examiner* — Larry Furdge
(74) *Attorney, Agent, or Firm* — Baker Botts L.L.P.

(57) ABSTRACT

A system comprising an air conditioning unit operable to run at a capacity level determined by a difference between a temperature set-point and an actual temperature of an environment. The system comprises a humidity sensor, a temperature sensor, and a controller. The controller comprises a memory and a microprocessor. The controller is operable to operate the air conditioning unit in a normal mode and a tracking mode comprising operating the air conditioning unit at a reduced capacity comprising setting the temperature set-point of the air conditioning unit as a tracked actual temperature of the environment. The controller is operable to terminate the tracking mode if the actual temperature of the environment either rises above the first temperature value or drops below the second temperature value, or if the humidity level of the environment drops below the humidity threshold.

20 Claims, 4 Drawing Sheets

OPTIMIZED DEHUMIDIFICATION WITH HVAC SYSTEMS

TECHNICAL FIELD

This disclosure relates generally to HVAC (heating, ventilating, and air conditioning) systems, and more specifically to system and method for effective dehumidification.

BACKGROUND

HVAC systems are sometimes used to dehumidify an environment. One way of achieving this dehumidification is by lowering the temperature of the humid environment. Present HVAC systems are ineffective and inefficient at achieving such dehumidification. Thus, methods and systems are needed to effectively and efficiently dehumidify an environment.

SUMMARY

According to one embodiment, a system comprising an air conditioning unit operable to run at a capacity level determined by a difference between a temperature set-point and an actual temperature of an environment is disclosed. The system comprises a humidity sensor for measuring humidity level of the environment, a temperature sensor for measuring the actual temperature of the environment, and a controller. The controller comprises a memory operable to store a first temperature value and a second temperature value that is below the first temperature value. The controller further comprises a microprocessor operable to operate the air conditioning unit in a normal mode wherein the temperature set-point of the air conditioning unit is the first temperature value, operate the air conditioning unit in a tracking mode comprising operating the air conditioning unit at a reduced capacity, tracking the actual temperature of the environment, and setting the temperature set-point of the air conditioning unit as the tracked actual temperature of the environment wherein the tracking mode is triggered when the humidity level of the environment rises above a humidity threshold, the actual temperature of the environment is at or below the first temperature value, and the actual temperature of the environment is above the second temperature value, and terminate the tracking mode if the actual temperature of the environment either rises above the first temperature value or drops below the second temperature value, or if the humidity level of the environment drops below the humidity threshold.

The present embodiment presents several technical advantages. First, the present embodiment allows an HVAC system to effectively dehumidify an environment without needing any additional equipment. Second, using the present embodiment, an HVAC system can dehumidify an environment while maintaining a steady and comfortable climate in the environment. And third, the present embodiment reduces inefficiencies introduced into an HVAC system as the system enters a duty cycle.

Certain embodiments of the present disclosure may include some, all, or none of these advantages. One or more other technical advantages may be readily apparent to those skilled in the art from the figures, descriptions, and claims included herein.

BRIEF DESCRIPTION OF THE DRAWINGS

For a more complete understanding of the present disclosure and the advantages thereof, reference is now made to the following Detailed Description taken in conjunction with the accompanying drawings, in which.

DETAILED DESCRIPTION OF THE DRAWINGS

Figure 1:
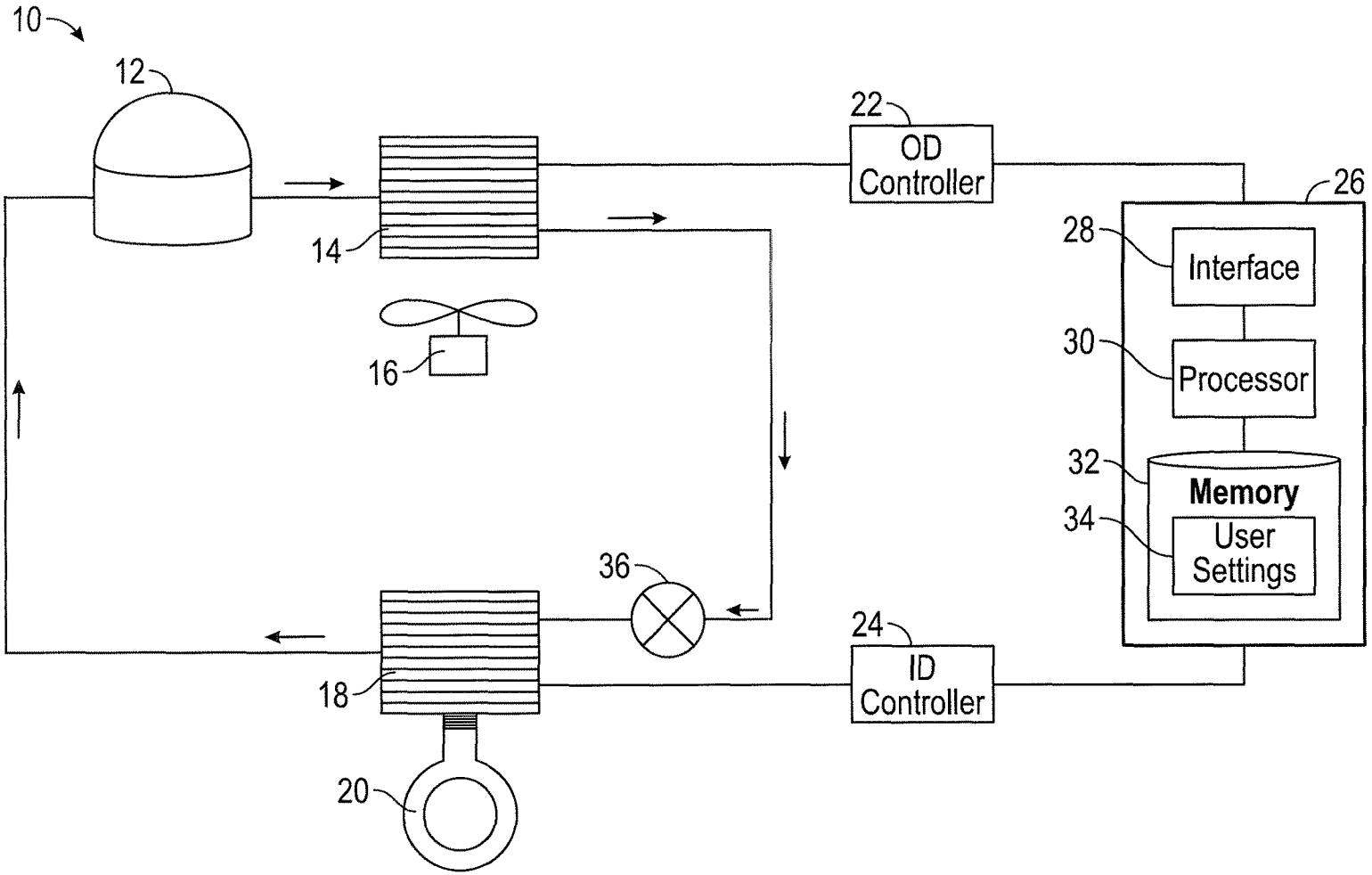
FIG. 1 illustrates a general overview of a residential HVAC system according to one embodiment of the present disclosure.

Embodiments of the present disclosure and its advantages are best understood by referring to FIGS. 1 through 4 of the drawings, like numerals being used for like and corresponding parts of the various drawings.

HVAC systems are commonplace in homes and industrial settings. Such systems regulate the air quality and temperature of the environment in which they are installed. In some HVAC systems, a user may set an air conditioner at a user-defined set-point temperature to keep the environment at a certain temperature. The HVAC system may keep the environment at that temperature by directing cool air from an air conditioning unit into ducts that guide the air to a suitable location. For example, in a home, an air conditioner may cool air using a compressor and coils and then push that cooled air into ducts that release the cooled air into the various rooms of the home through vents.

Such HVAC systems can sometimes be used to reduce the humidity of an environment. Generally, dehumidification can be achieved by lowering the temperature of an environment so that excess moisture in the environment condenses. In environments that are regulated using HVAC systems, the HVAC system may cool the environment to a dehumidification set-point temperature which causes the moisture in the environment to condense. As the moisture in the environment condenses, the environment becomes less humid. One way of alerting an HVAC system of high humidity levels is by measuring the humidity of the environment and sending a signal to the HVAC system to trigger a dehumidification mode when the humidity level rises above a threshold. In this dehumidification mode, the HVAC system may ignore the user-defined set-point temperature and attempt to lower the temperature of the environment to the lower dehumidification set-point temperature to remove the excess moisture from the air. So, for example, the user-defined set-point temperature for an HVAC system may be 70° F. However, the dehumidification set-point temperature may be 68° F. Thus the HVAC system may try to cool the environment to 68° F. if the humidity level of the environment is measured at being at or above a threshold humidity level, e.g. 60% humidity.

One drawback of such an approach is that HVAC systems typically attempt to reach the cooler dehumidification set-point temperature quickly which introduces inefficiencies in the HVAC system. For example, when an HVAC system attempts to change an environment temperature from 70° F. to 68° F., it may do so by running at full capacity until the temperature is at 68° F. and then duty-cycling, i.e. turning on and off, to maintain the temperature at 68° F. As the HVAC system duty-cycles, the humidity of the environment builds up while the HVAC system is in the "off" phase and then lowers when the HVAC system is in the "on" phase and then builds up again in the "off" phase. This approach is inefficient because as the HVAC system duty-cycles, the average humidity of the environment is not effectively lowered.

The present disclosure contemplates an embodiment whereby such duty-cycling of an HVAC system is reduced as the HVAC system attempts to lower the humidity of an environment. In one embodiment, in response to triggering a dehumidification mode, the HVAC system attempts to slowly lower the temperature of the environment to the dehumidification set-point temperature. The HVAC system achieves this by running at a reduced capacity while the HVAC system is in the dehumidification mode until the environment temperature reaches the lower dehumidification set-point temperature.

In one embodiment, the HVAC system may be controlled by a PI (proportional-integral) controller. In such an embodiment, the PI controller may dictate the behavior of the HVAC system. The PI controller may, for example, measure both the positive and negative difference between the actual temperature of the environment and the user-defined set-point temperature. The PI controller may then run the HVAC system so that the aggregate difference over time approaches zero. So, for example, the PI controller may measure a positive difference if the actual temperature is greater than the user-defined set-point temperature and a negative difference if the actual temperature drops below the user-defined set-point temperature. The PI controller causes the HVAC system to run so that the actual temperature oscillates, in a converging envelope, around the user-defined set-point temperature so that the aggregate and actual error approach zero.

In embodiments where the HVAC system is controlled by a PI controller, triggering the dehumidification mode, which changes the set-point temperature of the HVAC system from the user-defined set-point temperature to the lower dehumidification set-point temperature, may cause the PI controller to register a large error. The PI controller may attempt to correct this error by forcing the HVAC system to run at a high capacity until the environment is cooled to the dehumidification set-point temperature. Once the environment reaches the dehumidification set-point temperature, however, the HVAC system may shut off to prevent the environment from becoming cooler. As the temperature of the environment begins to rise, the HVAC system may turn back on to cool the environment. This leads to the problem of duty-cycling discussed above.

One way of preventing the PI controller from registering a large error when the HVAC system goes into dehumidification mode is by activating a tracking mode while the HVAC system is in dehumidification mode and the actual temperature of the environment is between the user-defined set-point temperature and the dehumidification set-point temperature. In tracking mode, the PI controller tracks the actual temperature of the environment and sets the actual temperature as its new set-point temperature. In this manner, the error recorded by the PI controller while the actual temperature is in between the user-defined set-point temperature and the dehumidification set-point temperature for any given time is zero and the aggregated error does not increase. This allows the HVAC system to run at a reduced capacity without affecting the operation of the HVAC system in temperature ranges outside the user-defined set-point temperature-dehumidification set-point temperature range.

Figure 2:
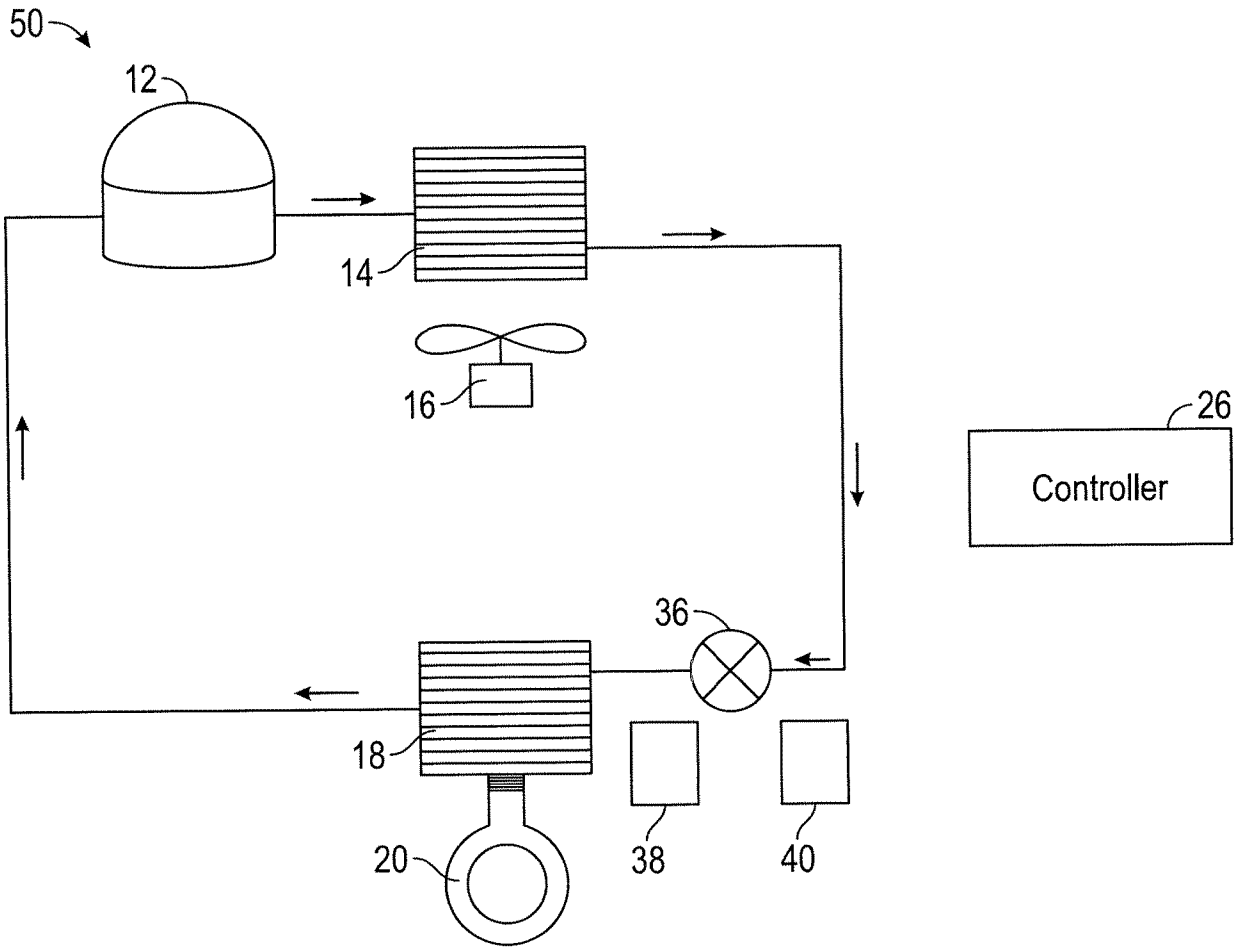
FIG. 2 illustrates a general overview of a commercial HVAC system according to one embodiment of the present disclosure.
Figure 3:
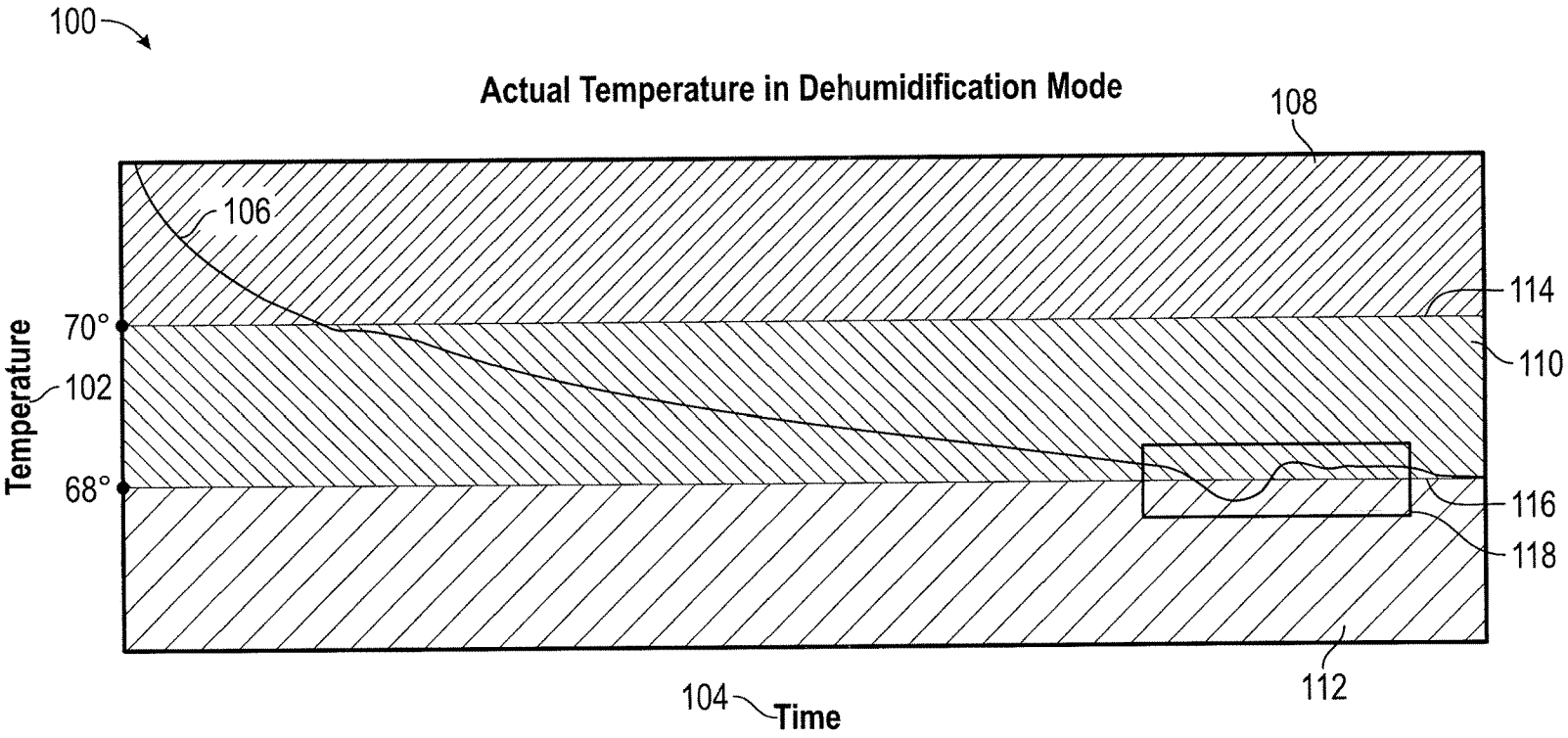
FIG. 3 illustrates a chart showing the relationship between time and actual temperature of an environment regulated by an HVAC system of the present disclosure.
Figure 4:
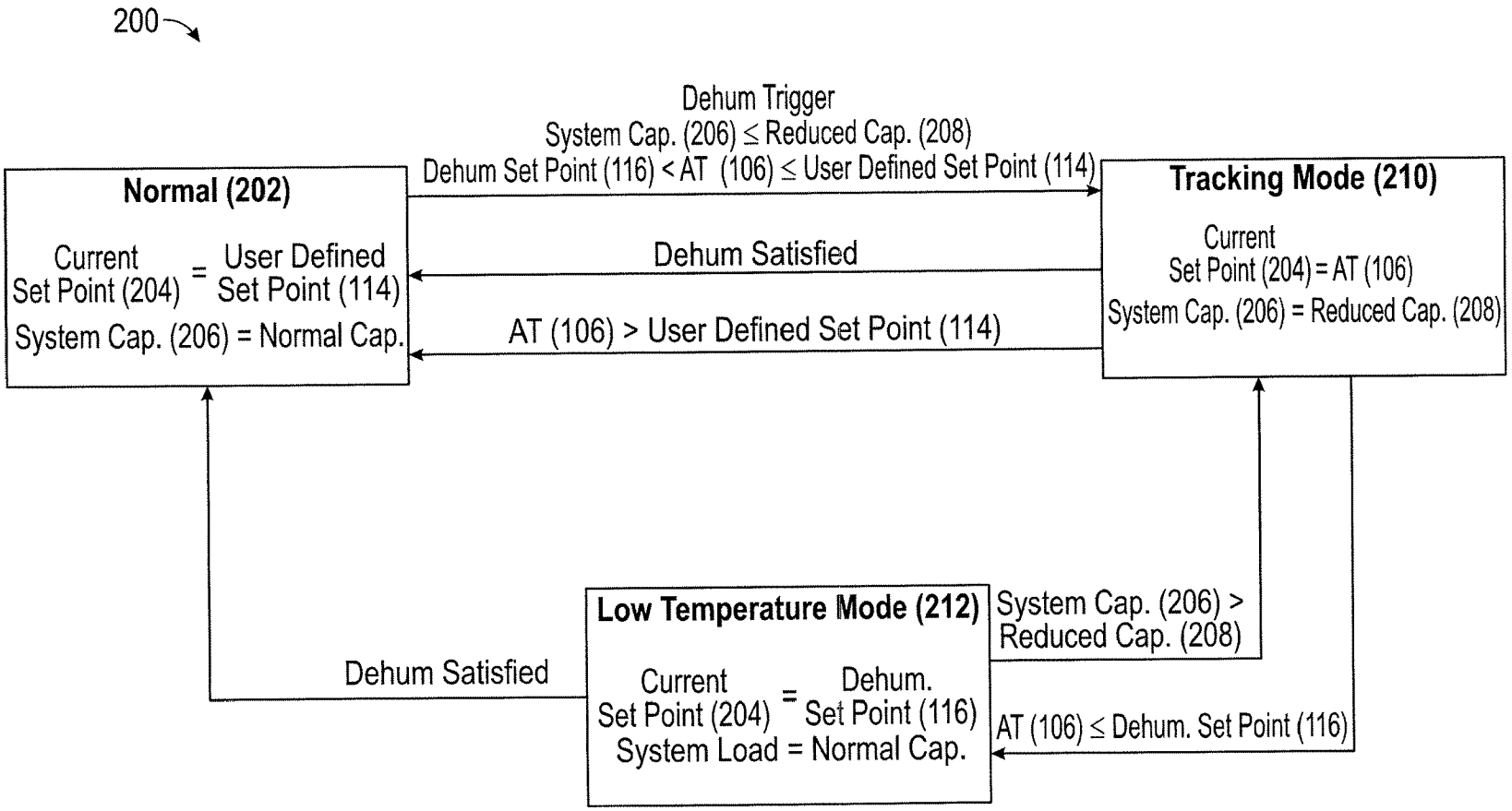
FIG. 4 illustrates a state diagram showing the behavior of an HVAC system of the present disclosure.

The present disclosure will be described in more detail using FIGS. 1 through 4. FIG. 1 illustrates a general overview of a residential HVAC system according to one embodiment of the present disclosure. FIG. 2 illustrates a general overview of a commercial HVAC system according to one embodiment of the present disclosure. FIG. 3 illustrates a chart showing the relationship between time and actual temperature of an environment regulated by an HVAC system of the present disclosure in a dehumidification range. And FIG. 4 illustrates a state diagram showing the behavior of an HVAC system of the present disclosure.

FIG. 1 illustrates a system 10 for cooling and dehumidifying a residential environment. System 10 comprises a compressor 12, condensing coil 14, fan 16, evaporating coil 18, blower 20, outdoor controller 22, indoor controller 24, central controller 26, and valve 36. In system 10, compressor 12 pumps a refrigerant gas up to a high pressure and temperature and supplies it to condensing coil 14. The refrigerant then converts into a liquid phase as it flows through condensing coil 14. Fan 16 may regulate this condensing process by blowing ambient outside air over condensing coil 14. The liquid refrigerant then flows through valve 36 into evaporating coil 18 inside the environment. Blower 20 blows uncooled air across evaporating coil 18. As the refrigerant passes through evaporating coil 18, the refrigerant absorbs heat from the air pushed by blower 20 and cools that air. As shown, some parts of system 10, including for example outdoor coil 14 and fan 16 may be positioned outdoors whereas other parts of system 10, including for example indoor coil 18 and blower 20 may be positioned indoors.

Compressor 12 may be any electromechanical unit operable to pump a refrigerant gas up to a high pressure and temperature and circulate the refrigerant through condensing coil 14. Compressor 12 may be any type of compressor including, for example, a reciprocating compressor or a scroll compressor. Compressor 12 may be single speed or a multispeed. Compressor 12 may be powered by any suitable power source and may function using any suitable type of refrigerant. Compressor 12 may be electrically coupled to outdoor controller 22, indoor controller 24, and/or central controller 26.

Condensing coil 14 may be any coil system for condensing the refrigerant and transporting it. Condensing coil 14 may be made of any suitable material. Condensing coil 14 may be coupled to compressor 12 so that the refrigerant may be transported from compressor 12 to condensing coil 14 and on to evaporating coil 18.

Evaporating coil 18 may be any coil operable to allow the condensed refrigerant to expand. Evaporating coil 18 may be coupled to condensing coil 14 and compressor 12. Evaporating coil 18 may be placed adjacent to or be coupled to blower 20.

Blower 20 may be any electromechanical device for blowing air across evaporating coil 18. Blower 20 may comprise a fan or any other suitable mechanism for propelling air. Blower 20 may be powered by any suitable power source. Similarly, fan 16 may be any electromechanical device for blowing outdoor air across condensing coil 14. Blower 20 and/or fan 16 may be single speed or multispeed.

Valve 36 may be any thermal expansion valve or metering device operable to regulate the amount of refrigerant flowing from condensing coil 14 into evaporator coil 18. Valve 36 may be operable to receive signals from central controller 26 to regulate the refrigerant flow. Valve 36 may be operable to increase or decrease the pressure of the refrigerant based on the temperature needs of system 10. System 10 may have any number of suitable valves 36.

Outdoor controller 22 may be any electrical, mechanical, or electro-mechanical controller for operating compressor 12 and/or fan 16. Outdoor controller 22 may include independent processing software and hardware or it may follow instructions provided to it by central controller 26. Similarly, indoor controller 24 may be any electrical, mechanical, or electro-mechanical controller for operating blower 20. Like outdoor controller 22, indoor controller 24 may include independent processing software and hardware or it may follow instructions provided to it by central controller 26. Either or both of outdoor controller 22 and indoor controller 24 may have interfaces for receiving user input.

Central controller 26 may be any module operable to regulate the operation of compressor 12, fan 16, blower 20 and/or valve 36. Central controller 26 may regulate the operation of the various components of system 10 depending upon the demand or load on system 10. So, for example, central controller 26 may shut off the various components of system 10 if the measured temperature of the environment is below a user-defined set-point temperature. In operation, central controller 26 may run the various components of system 10 at any suitable capacity including a normal capacity which ranges from a reduced capacity, such as a minimum capacity, up to a high capacity, such as a maximum capacity, depending upon the cooling requirements, i.e. the load or the demand, of the environment. Operating system 10 at a reduced capacity may involve running compressor 12, fan 16, and/or blower 20 at a speed or power level that is lower than the highest speed or power level, i.e. the maximum capacity, at which the apparatus may operate. Operating system 10 at a minimum capacity may involve running compressor 12, fan 16, and/or blower 20 at the lowest speed or power level that the apparatus may operate at continuously without shutting off. In one embodiment, central controller 26 may be a PI controller and may determine the cooling requirements of the environment based not only on the current difference between the measured temperature and the user-defined set-point temperature but also on the historical difference between the measured temperature and the user-defined set-point temperature.

Further, central controller 26 may be operable to measure the indoor temperature of the environment as well as the humidity of the environment. In other embodiments, central controller 26 may be operable to receive temperature and humidity measurements from sensors that are remote from central controller 26. Such sensors may include a humidity sensor 38 and a temperature sensor 40. Humidity sensor 38 may be any sensor that is operable to measure the humidity of an environment by, for example, measuring the amount of moisture in that environment. Humidity sensor 38 may be any type of hygrometer including any capacitive, resistive, thermal, gravimetric or any other suitable hygrometer. Temperature sensor 40 may be any sensor operable to measure the temperature of an environment, including, for example, a mercury or alcohol based thermometer. In some embodiments, temperature sensor 40 may be an electronic temperature sensor. Humidity sensor 38 and temperature sensor 40 may be placed at any suitable location in the relevant environment.

Central controller 26 may further comprise an interface 28, a processor 30, and a memory 32.

Interface 28 may be operable to receive information from and transmit information to the various components of system 10. Interface 28 may also communicate with processor 30 and memory 32. Interface 28 represents any port or connection, real or virtual, including any suitable hardware and/or software, including protocol conversion and data processing capabilities, to communicate through a LAN, WAN, or other communication system that allows central controller 26 to exchange information with compressor 12, fan 16, blower 20, valve 36, and/or any other components of system 10.

Processor 30 may be any electronic circuitry, including, but not limited to microprocessors, application specific integrated circuits (ASIC), application specific instruction set processor (ASIP), and/or state machines, that communicatively couples interface 28 and memory 32 and controls the operation of central controller 26. In some embodiments, processor 30 may be single core or multi-core having a single chip containing two or more processing devices. Processor 30 may be 8-bit, 16-bit, 32-bit, 64-bit or of any other suitable architecture. Processor 30 may comprise an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components. Processor 30 may include other hardware and software that operates to control and process information. Processor 30 may execute computer-executable program instructions stored in memory 32. Processor 30 is not limited to a single processing device and may encompass multiple processing devices.

Memory 32 may include any one or a combination of volatile or non-volatile local or remote devices suitable for storing information. For example, memory 32 may include RAM, ROM, flash memory, magnetic storage devices, optical storage devices, network storage devices, cloud storage devices, solid state devices, or any other suitable information storage device or a combination of these devices. Memory 32 stores, either permanently or temporarily, data, operational software, other information for processor 30, other components of central controller 26, or other components of system 10. For example, memory 32 may store user preferences or default settings for operating central controller 26. Memory 32 may store information in one or more databases, file systems, tree structures, relational databases, any other suitable storage system, or any combination thereof. Furthermore, different information stored in memory 32 may use any of these storage systems. The information stored in memory 32 may be encrypted or unencrypted, compressed or uncompressed, and static or editable. Memory 32 may store information in one or more caches.

While illustrated and described separately, outdoor controller 22, indoor controller 24, and central controller 26 may be integrated into any suitable number and combination of controllers. For example, in some embodiments, central controller 26 may perform the functions of outdoor controller 22, indoor controller 24, and central controller 26. Similarly, any of controller 22, 24, and 26 may be placed indoor, outdoor, or at any suitable location.

In the present embodiment, memory 32 stores user settings 34. User settings 34 may comprise information such as a user-defined set-point temperature and a dehumidification set-point temperature. The user-defined set-point temperature may be a temperature setting that defines the temperature value a user wishes to maintain in an environment while system 10 is operating. For example, a user may set user-defined set-point temperature to 70° F. so that system 10 maintains the environment temperature at or around 70° F. while system 10 is operating. Dehumidification set-point temperature may be a different temperature setting that is lower than the user-defined set-point temperature. The dehumidification set-point temperature may specify a temperature value that system 10 may drop to when system 10 needs to dehumidify the environment. Dehumidification set-point temperature may also be defined by a user or it may be a default setting. For example, a default setting may dictate that the dehumidification set-point temperature is two degrees lower than the user-defined set-point temperature or the user may specify that when system 10 needs to dehumidify the environment, system 10 may switch from the user-defined set-point temperature to the dehumidification set-point temperature. Thus, in one example, if the user-defined set-point temperature is 70° F. then the dehumidification set-point temperature may be 68° F.

In operation, central controller 26 may detect or receive a signal indicating that the humidity level of an environment is above a threshold. In response, central controller 26 may trigger a dehumidification mode whereby the temperature set-point temperature for system 10 changes from the user-defined set-point temperature to the dehumidification set-point temperature. Central controller 26 may then regulate the operation of compressor 12, fan 16, blower 20, and/or valve 36 to bring the temperature of the environment down from the actual temperature to the dehumidification set-point temperature. The manner in which system 10 responds to the triggering of the dehumidification mode may depend on whether central controller 26 is a PI controller, the current temperature of the environment, and the current demand on system 10 (i.e. whether system 10 is off, operating at a reduced capacity, a high capacity, or somewhere in between) as explained in greater detail with respect to FIGS. 3 and 4 below.

FIG. 2 illustrates a commercial embodiment of an HVAC system 50. System 50 may comprise apparatuses and devices analogous to the apparatuses and devices comprising system 10. For example, like system 10, system 50 may comprise compressor 12, condensing coil 14, fan 16, evaporating coil 18, blower 20, central controller 26, and valve 36. Further system 50 may comprise a humidity sensor 38 and a temperature sensor 40 deployed inside a commercial environment. System 50 may be positioned entirely outdoors or indoors. System 50 may thus comprise one packaged unit that is deployed at a suitable location inside or outside a commercial environment. Further, central controller 26 may operate system 50 from a remote location. Central controller 26 may be wirelessly coupled to various components of system 50, including compressor 12, fan 16, blower 20, valve 36, humidity sensor 38, and temperature sensor 40. In such embodiments, one or more central controllers 26 may be operated from a central location and central controller 26 may regulate one or more systems 50.

FIG. 3 illustrates a chart 100 showing the relationship between temperature 102 and time 104 while system 10 is in dehumidification mode according to one embodiment of the present disclosure. The dehumidification mode is triggered when central controller 26 receives a signal or measures a humidity value indicating that the humidity of the environment is above a threshold. As shown, actual temperature 106 may be in one of three temperature ranges illustrated by different hashed regions of chart 100: high temperature range 108, dehumidification range 110, and low temperature range 112. The various temperature ranges may be defined with respect to a user-defined set-point temperature 114 and a dehumidification set-point temperature 116. While system 10 is in a dehumidification mode, central controller 26 may operate system 10 so that actual temperature 106 generally stays within dehumidification range 110.

User-defined set-point temperature 114 may be a temperature value defined by a user and that defines the temperature at which the user wishes to maintain the temperature of the environment under normal operating conditions. In the example illustrated in FIG. 3, the user-defined set-point temperature 114 is 70° F. This example is in no way limiting and user-defined set-point temperature 114 may, in other embodiments, be any suitable temperature.

Dehumidification set-point temperature 116 may be a temperature value that is lower than the user-defined set-point temperature 114. Dehumidification set-point temperature 116 may define the temperature of the environment that system 10 may maintain when system 10 is in dehumidification mode. Dehumidification set-point temperature 116 may be set by a user or it may be a default setting of central controller 26. In the example illustrated in FIG. 3, the dehumidification set-point temperature 116 is 68° F. which is two degrees lower than the user-defined set-point temperature 114 of 70° F. This example is in no way limiting and the dehumidification set-point temperature 116 may, in other embodiments, be any suitable temperature.

While system 10 is in a dehumidification mode, high temperature range 108 may be defined by the region where the actual temperature 106 of the environment is greater than the user-defined set-point temperature 114. In this high temperature range 108, central controller 26 may, through any suitable means, reduce the actual temperature 106 to bring actual temperature 106 into dehumidification range 110.

While system 10 is in a dehumidification mode, low temperature range 112 may be defined by the region where the actual temperature 106 of the environment is lower than the dehumidification set-point temperature 116. In this low temperature range 112, central controller 26 may try to raise the actual temperature 106 to the dehumidification set-point temperature 116 through any suitable means. For example, central controller 26 may raise actual temperature 106 by shutting off system 10.

While system 10 is in a dehumidification mode, dehumidification range 110 may be defined by the region where actual temperature 106 is less than or equal to the user-defined set-point temperature 114 and greater than the dehumidification set-point temperature 116. While the actual temperature 106 is within this dehumidification range 110, central controller 26 may operate system 10 at a reduced capacity, such as, for example, a minimum capacity, without shutting down so that actual temperature 106 remains within this dehumidification range 110 for as long as possible or appropriate. By so doing, system 10 may reduce the amount of duty cycling of system 10 while system 10 is in a dehumidification mode.

However, even though the disclosed embodiment reduces the amount of duty-cycling of system 10 while system 10 is in dehumidification mode, if actual temperature 106 drops below dehumidification set-point temperature 116, as shown by region 118, central controller 26 may need to shut off system 10 so that actual temperature 106 does not drop further below dehumidification set-point temperature 116. As actual temperature 106 rises above dehumidification set-point temperature 116, system 10 may once again start running at a reduced capacity to maintain actual temperature 106 in dehumidification range 110.

As explained above, in some embodiments, central controller 26 may be a PI (proportional-integral) controller. In such an embodiment, the PI central controller 26 may dictate the behavior of system 10 by, for example, measuring both the positive and negative difference between the actual temperature 106 of the environment and the user-defined set-point temperature 114. The PI central controller 26 may then run system 10 so that the aggregate difference over time of the actual temperature 104 versus the user-defined set-point temperature 114 is close to zero.

In embodiments where system 10 has a PI central controller 26, changing the user-defined set-point temperature 114 to the lower dehumidification set-point temperature 116 in the dehumidification mode may cause the PI central controller 26 to register a large error. The present embodiment contemplates approaches for preventing PI central controller 26 from registering this large error. If PI central controller 26 registers the large error in response to triggering dehumidification mode, PI central controller 26 may attempt to correct the error by running system 10 at a high capacity until actual temperature 106 reaches dehumidification set-point temperature 116. Once actual temperature 106 reaches dehumidification set-point temperature 116, PI central controller 26 may shut off system 10 to prevent actual temperature 106 from dropping further below dehumidification set-point temperature 116. As actual temperature 106 begins to rise, PI central controller 26 may turn system 10 back on to cool the environment. Once actual temperature 106 drops below dehumidification set-point temperature 116 again, PI central controller may once again shut off system 10. This leads to the problem of duty-cycling discussed above.

One way of preventing the PI central controller 26 from registering a large error when system 10 goes into dehumidification mode is by activating a tracking mode while system 10 is in dehumidification mode and actual temperature 106 is between the user-defined set-point temperature 114 and dehumidification set-point temperature 116. In tracking mode, PI central controller 26 tracks actual temperature 106 and sets actual temperature 106 as its new set-point temperature. PI central controller 26 then tries to maintain this new set-point temperature by operating system 10 at a reduced capacity. As actual temperature 106 changes, PI central controller 26 may continue adjusting its new set-point temperature so that the new set-point temperature matches actual temperature 106. In this manner, the difference between actual temperature 106 and PI central controller 26's new set-point temperature is zero (or close to zero) and the error recorded by the PI central controller 26 while actual temperature 106 is in between the user-defined set-point temperature 114 and the dehumidification set-point temperature 116 is also zero (or close to zero). Thus, the aggregated error calculated by PI central controller 26 does not increase. This allows system 10 to continue running at a reduced capacity while system 10 is in tracking mode without affecting the operation of system 10 in temperature ranges outside dehumidification range 110. In this manner, the duty-cycling of system 10 is reduced and actual temperature 106 is gradually lowered to dehumidification set-point temperature 116 resulting in more efficient dehumidification.

FIG. 4 illustrates a state diagram 200 showing the behavior of system 10 in the embodiment where central controller 26 is a PI controller.

State diagram 200 starts with system 10 in a normal state 202. In normal state 202, the set-point temperature 204 of system 10 is equal to the user-defined set-point temperature 114. Set-point temperature 204 is the temperature that system 10 is attempting to cool actual temperature 106 to. So, for example, when set-point temperature 204 is equal to the user-defined set-point temperature 114, then system 10 is attempting to cool actual temperature 106 to user-defined set-point temperature 114. In the example set forth in FIG. 3 above, the user-defined set-point temperature 114 is 70° F. So in that example, in normal state 202, system 10 attempts to cool the actual temperature 106 to 70° F.

Returning to FIG. 4, in normal state 202, system 10 operates at any system capacity 206 that is suitable to bring actual temperature 106 to set-point temperature 204. So, carrying forward the example of FIG. 3, if the actual temperature 106 is 78° F., system 10 may run at a high capacity to bring actual temperature 106 down to the user-defined set-point temperature 114 of 70° F.

In one embodiment, system 10 leaves normal state 202 and enters tracking mode 210 when one or more conditions are satisfied. For example, system 10 may leave normal state 202 when a dehumidification mode is triggered and the actual temperature 106 is within dehumidification range 110. A dehumidification mode may be triggered if the humidity of the environment rises above a threshold humidity level. Further, in some embodiments, system 10 may leave normal state 202 and enter tracking mode 210 only if system 10 is running at reduced capacity 208 when the dehumidification mode is triggered.

In tracking mode 210, system 10 operates at reduced capacity 208. Additionally, the set-point temperature 204 of system 10 switches from the user-defined set-point temperature 114 to the actual temperature 106. In this manner, the error measured by the PI central controller 26 is zero because the difference between the actual temperature 106 and current set-point temperature 204, which now tracks actual temperature 106, is zero. Because this measured error is zero, the aggregate error measured by the PI central controller 26 does not change and system 10 continues to operate at reduced capacity 208.

System 10 may leave tracking mode 210 in one of several ways. For example, system 10 may leave tracking mode 210 and return to the normal state 202 if the PI central controller 26 receives a signal or measures a humidity level that is below the threshold humidity. For example, if the threshold humidity is 60% and the PI central controller 26 measures a humidity level of 55%, PI central controller 26 may exit tracking mode 210 and return to normal mode 202. Additionally, system 10 may exit tracking mode 210 and return to normal mode 202 if actual temperature 106 of the environment rises above user-defined set-point temperature 114. In such a scenario, system 10 may need to operate at higher than reduced capacity 208 to lower actual temperature 106 and bring it back into dehumidification range 110. Additionally, system 10 may exit tracking mode 210 and enter a low temperature mode 212 if actual temperature 106 drops below dehumidification set-point temperature 116. In such a scenario, PI central controller 26 stops tracking actual temperature 106 and set-point temperature 204 changes from actual temperature 106 to dehumidification set-point temperature 116. In low temperature mode 212, system 10 may operate normally to maintain actual temperature 106 at or near dehumidification set-point temperature 116.

System 10 may exit low temperature mode 212 in one of several ways. For example, system 10 may exit low temperature mode 212 and return to normal state 202 if system 10 measures a humidity level that is below the threshold humidity level. So, for example, if, while system 10 is in low temperature mode 212, the humidity level of the environment drops from a threshold of 60% humidity to 55% humidity, system 10 may return to normal state 202 and set-point temperature 204 may return to user-defined set-point temperature 114.

On the other hand, if the humidity level remains above the threshold humidity and actual temperature 106 returns to dehumidification range 110, system 10 may exit low temperature mode 212, return to tracking mode 210 and begin operating at reduced capacity 208. In this manner, PI central controller 26 may regulate system 10 to efficiently and effectively cool and dehumidify an environment.

Modifications, additions, or omissions may be made to the systems, apparatuses, and processes described herein without departing from the scope of the disclosure. The components of the systems and apparatuses may be integrated or separated. Moreover, the operations of the systems and apparatuses may be performed by more, fewer, or other components. The methods may include more, fewer, or other steps. Additionally, steps may be performed in any suitable order. Additionally, operations of the systems and apparatuses may be performed using any suitable logic. As used in this document, "each" refers to each member of a set or each member of a subset of a set.

Although several embodiments have been illustrated and described in detail, it will be recognized that substitutions and alterations are possible without departing from the spirit and scope of the present disclosure, as defined by the appended claims. To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

The invention claimed is:

1. A system comprising:

an air conditioning unit operable to run at a capacity level determined by a difference between a temperature set-point and an actual temperature of an environment;

a humidity sensor for measuring humidity level of the environment;

a temperature sensor for measuring the actual temperature of the environment; and a controller comprising:

a memory operable to store:

a first temperature value; and a second temperature value that is below the first temperature value;

a microprocessor operable to:

operate the air conditioning unit in a normal mode wherein the temperature set-point of the air conditioning unit is the first temperature value;

operate the air conditioning unit in a tracking mode comprising operating the air conditioning unit at a reduced capacity, tracking the actual temperature of the environment, and setting the temperature set-point of the air conditioning unit as the tracked actual temperature of the environment;

wherein the tracking mode is triggered when the humidity level of the environment rises above a humidity threshold, the actual temperature of the environment is at or below the first temperature value, and the actual temperature of the environment is above the second temperature value; and terminate the tracking mode if the actual temperature of the environment either rises above the first temperature value or drops below the second temperature value, or if the humidity level of the environment drops below the humidity threshold.

2. The system of claim 1, wherein in response to terminating the tracking mode if the actual temperature of the environment rises above the first temperature value or if the humidity level of the environment drops below the humidity threshold, the controller being operable to operate the air conditioning unit in the normal mode.

3. The system of claim 1, wherein in response to terminating the tracking mode if the actual temperature of the environment drops below the second temperature value, the controller being operable to operate the air conditioning unit in a low-temperature mode wherein the temperature set-point of the air conditioning unit is the second temperature value.

4. The system of claim 3, wherein the controller is operable to terminate the low-temperature mode and operate the air conditioning unit in the normal mode if the humidity level of the environment drops below the humidity threshold.

5. The system of claim 3, wherein the controller is operable to terminate the low-temperature mode and operate the air conditioning unit in the tracking mode if the actual temperature of the environment rises above the second temperature value.

6. The system of claim 1, wherein operating the air conditioning unit at a reduced capacity further comprises operating a compressor, a blower, or a fan comprising the air conditioning unit at a low power setting.

7. The system of claim 1, wherein the controller is a proportional-integral controller.

8. A method comprising:

operating an air conditioning unit in a normal mode at a capacity level determined by a difference between a temperature set-point and an actual temperature of an environment wherein, in the normal mode, the temperature set-point of the air conditioning unit is a first temperature value;

triggering a tracking mode and operating the air conditioning unit in the tracking mode comprising operating the air conditioning unit at a reduced capacity, tracking the actual temperature of the environment, and setting the temperature set-point of the air conditioning unit as the tracked actual temperature of the environment wherein the tracking mode is triggered when a humidity level of the environment rises above a humidity threshold, the actual temperature of the environment is at or below the first temperature value, and the actual temperature of the environment is above a second temperature value; and terminating the tracking mode if the actual temperature of the environment either rises above the first temperature value or drops below the second temperature value, or if the humidity level of the environment drops below the humidity threshold.

9. The method of claim 8, wherein in response to terminating the tracking mode if the actual temperature of the environment rises above the first temperature value or if the humidity level of the environment drops below the humidity threshold, operating the air conditioning unit in the normal mode.

10. The method of claim 8, wherein in response to terminating the tracking mode if the actual temperature of the environment drops below the second temperature value, operating the air conditioning unit in a low-temperature mode comprising setting the temperature set-point of the air conditioning unit as the second temperature value.

11. The method of claim 10, further comprising terminating the low-temperature mode and operating the air conditioning unit in the normal mode if the humidity level of the environment drops below the humidity threshold.

12. The method of claim 10, further comprising terminating the low-temperature mode and operating the air conditioning unit in the tracking mode if the actual temperature of the environment rises above the second temperature value.

13. The method of claim 8, wherein operating air conditioning unit at a reduced capacity further comprises operating a compressor, a blower, or a fan comprising the air conditioning unit at a low power setting.

14. The system of claim 1, wherein the air conditioning unit is controlled by a proportional-integral controller.

15. A controller comprising:

a memory operable to store:

a first temperature value; and a second temperature value that is below the first temperature value; and a microprocessor operable to:

operate an air conditioning unit in a normal mode at a capacity level determined by a difference between a temperature set-point of the air conditioning unit and an actual temperature of an environment wherein, in the normal mode, the temperature set-point of the air conditioning unit is the first temperature value;

operate the air conditioning unit at a reduced capacity when the humidity level of the environment rises above a humidity threshold, the actual temperature of the environment is at or below the first temperature value, and the actual temperature of the environment is above the second temperature value; and terminate operating the air conditioning unit at the reduced capacity if the actual temperature of the environment either rises above the first temperature value or drops below the second temperature value, or if the humidity level of the environment drops below the humidity threshold.

16. The controller of claim 15, wherein in response to terminating operating the air conditioning unit at the reduced capacity if the actual temperature of the environment rises above the first temperature value or if the humidity level of the environment drops below the humidity threshold, the microprocessor is operable to operate the air conditioning unit in the normal mode.

17. The controller of claim 15, wherein in response to terminating operating the air conditioning unit at the reduced capacity if the actual temperature of the environment drops below the second temperature value, the microprocessor is operable to operate the air conditioning unit in a low-temperature mode wherein the temperature set-point of the air conditioning unit is the second temperature value.

18. The controller of claim 17, wherein the microprocessor is operable to terminate the low-temperature mode and operate the air conditioning unit in the normal mode if the humidity level of the environment drops below the humidity threshold.

19. The controller of claim 17, wherein the microprocessor is operable to terminate the low-temperature mode and operate the air conditioning unit at the reduced capacity if the actual temperature of the environment rises above the second temperature value.

20. The controller of claim 15, wherein the microprocessor is further operable to:

track the actual temperature of the environment and set the temperature set-point of the air conditioning unit as the tracked actual temperature of the environment when the humidity level of the environment rises above a humidity threshold, the actual temperature of the environment is at or below the first temperature value, and the actual temperature of the environment is above the second temperature value; and terminate tracking the actual temperature of the environment if the actual temperature of the environment either rises above the first temperature value or drops below the second temperature value, or if the humidity level of the environment drops below the humidity threshold.

* * * * *